US005226705A

United States Patent [19]

Rorke et al.

[11] Patent Number: 5,226,705

[45] Date of Patent: Jul. 13, 1993

[54] FURNITURE STANCHIONS WITH UNITARY POWER ROUTING SYSTEM

[75] Inventors: A. Brooks Rorke, Fairfield, Conn.; Wallace C. Bullwinkle, Norristown; William I. Stephens, Barto, both of Pa.; Robert E. Reuter, East Setauket, N.Y.; John J. Rizzi, Weston, Conn.

[73] Assignee: Westinghouse Electric Corp., Pittsburgh, Pa.

[21] Appl. No.: 713,219

[22] Filed: Jun. 11, 1991

Related U.S. Application Data

[63] Continuation-in-part of Ser. No. 536,873, Jun. 12, 1990, Pat. No. 5,160,188.

[51] Int. Cl.[5] ..... A47B 19/00

[52] U.S. Cl. ..... 312/196; 312/223.6; 108/50

[58] Field of Search ..... 52/28, 36, 221; 108/50; 312/196, 223, 198, 203, 223.6

[56] References Cited

U.S. PATENT DOCUMENTS

| | | | |
|---|---|---|---|
| 2,349,144 | 5/1944 | Corso | 52/28 |
| 2,912,073 | 11/1959 | Sherron | 52/28 |
| 4,094,256 | 6/1978 | Holper | 108/50 |
| 4,408,543 | 10/1983 | Griffin | 108/50 |
| 4,603,229 | 7/1986 | Menchetti . | |
| 4,646,211 | 2/1987 | Gallant . | |
| 4,762,072 | 8/1988 | Boundy | 108/50 |
| 4,974,915 | 12/1990 | Bussard | 108/50 |

*Primary Examiner*—James R. Brittain

*Assistant Examiner*—Gerald Anderson

*Attorney, Agent, or Firm*—C. J. Vrsansky

[57] ABSTRACT

A fully enclosed structural support stanchion for furniture is provided, having an internal cavity which may receive standard modular office furniture electrical service cabling, and which is provided with a demountable front accessory panel to which plural electrical or electronic accessories may be mounted such that a portion of the accessory extends into the stanchion and releasably connects to one end of the standard modular furniture electrical service cabling. The stanchion is constructed with rigid materials so that it can act as a support for an overhead bookshelf or other storage facility, and the stanchion is further provided with a large internal storage cavity into which small office supplies or other articles may be placed and stored behind a hinged, selectively closable door. The stanchion further includes an elongated bracket support which may receive standard shelf brackets, permitting the stanchion to act as a cantilever support for structures such as shelves secured to the shelf brackets. The internal cavity and demountable front-accessory panel of the stanchion may receive electrical service wiring comprising a conventional cable and connector shell rigidly mounted on a support bracket having a spring clip, enabling an electrical receptacle to be quickly and releasably secured to the mounting bracket spring clip while simultaneously mating electrical contacts on the receptacle with electrical contacts provided in the cable connector shell.

14 Claims, 7 Drawing Sheets

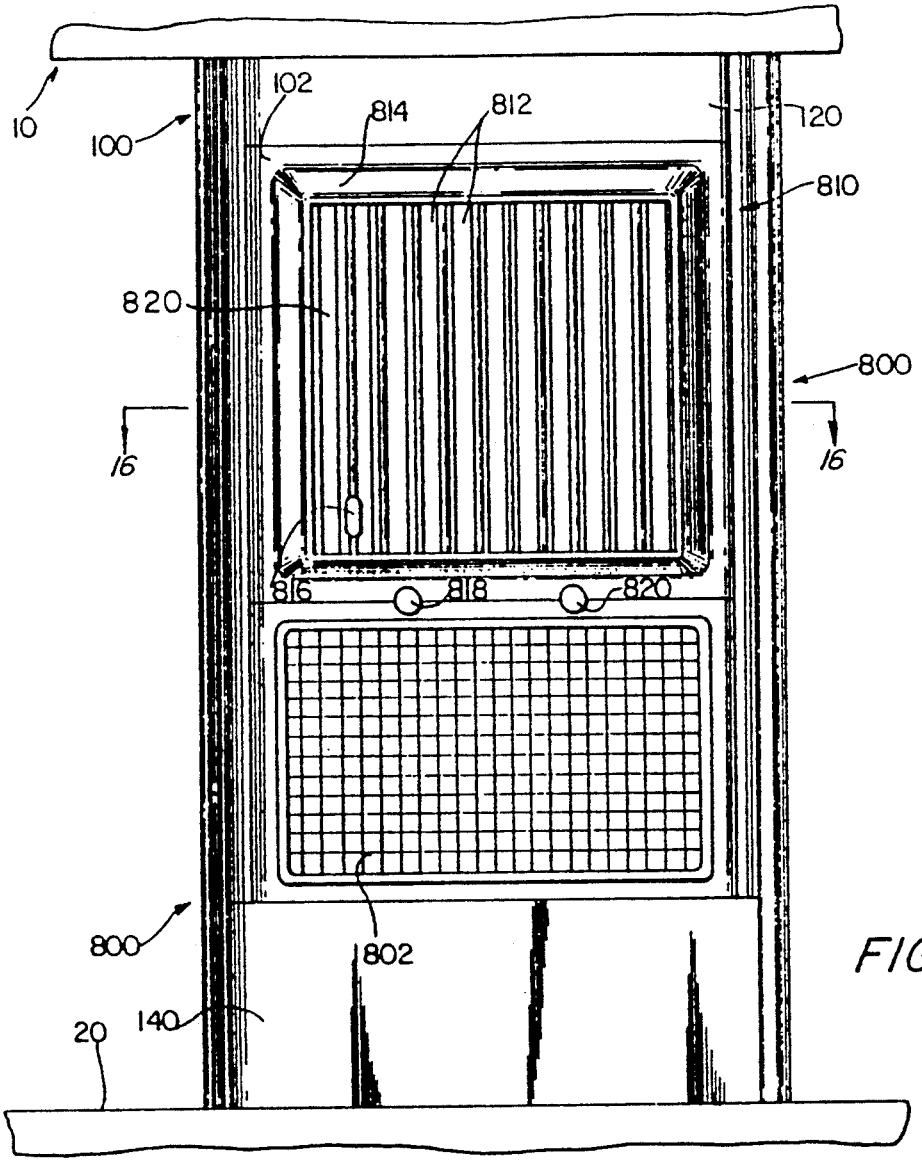
FIG. 15
FIG. 16
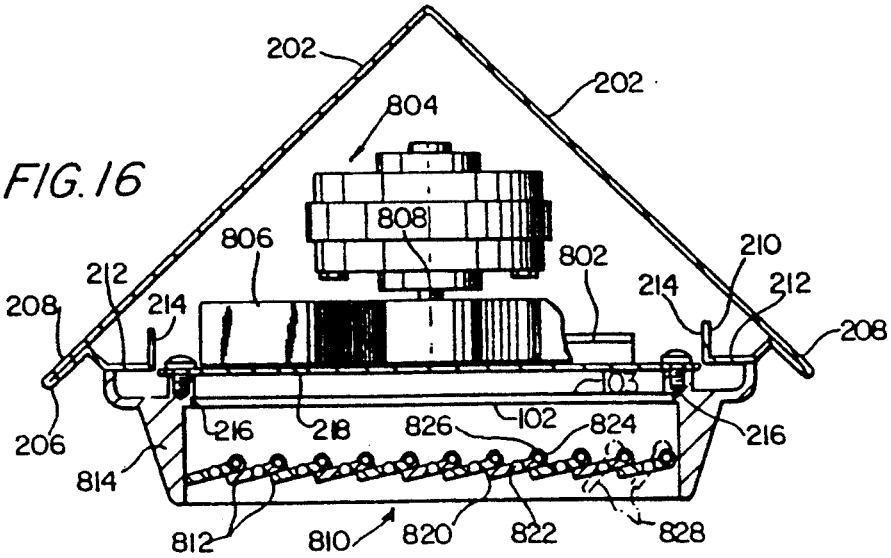

FURNITURE STANCHIONS WITH UNITARY POWER ROUTING SYSTEM

CROSS-REFERENCE TO RELATED APPLICATION

This application s a continuation-in-part of U.S. patent application Ser. No. 07/536,873, filed Jun. 12, 1990, now U.S. Pat. No. 5,160,188.

BACKGROUND OF THE INVENTION

1. Field Of The Invention

The present invention relates generally to modular office furniture. The present invention specifically relates to support stanchions for modular, free standing open-plan office furniture having unitary internal power routing facilities, and provision for selective mounting of plural electric and electronic accessories.

2. State Of The Prior Art

In the modern office environment, ready accessibility to electrical power is highly desirable. In today's office, common furniture such as desks and other work surfaces must coexist with a variety of electric and electronic equipment such as telephones, clocks, computers, adding machines, and many other types of devices. However, since office furniture is generally chosen and installed long after basic electrical service is installed in a typical office or office building, providing electrical service close to or mounted in a desk or work surface is difficult. Typically, office workers must use extension cords, multiple-outlet junction boxes, and other cumbersome and potentially dangerous means to route electrical power to a convenient location near the desk surface.

Prior inventors have attempted to combine electrical power service with furniture in various ways. For example, U.S. Pat. No. 3,862,785 (Scheerhorn, et al) discloses a secretarial work station including a work surface, end walls, a shelf and a partitioned upper portion which may receive a telephonic unit in one end. However, the work station of Scheerhorn, et al does not provide standard 120 VAC electrical service outlets for connection to different articles.

Another means for supplying power to particular places in an open-plan office is to use a floor-to-ceiling service pole such as that disclosed in U.S. Pat. No. 4,284,840 (Baker). The Baker patent provides plural outlets mounted in an elongated pole which extends from the floor to the ceiling. Electrical wiring is routed into the pole and connects to outlets. However, use of a service pole requires placing an obstacle in the office, which may affect furniture placement, and also requires running an extension cord to a desk, work surface, or other devices desired to be attached to the electrical service.

Still other inventors have attempted to integrate electrical service and office furniture by building the electrical facilities into the work surface. For example, U.S. Pat. No. 4,792,881 (Wilson et al) discloses a work surface with a power and communication module set into the rear portion of a work surface. The module includes plural outlets set into a power strip, and communications facilities provided in a module. The entire apparatus is located in a recess below the work surface and is accessible by lifting a hinged panel. However, the placement of the power module in the rear lateral portion of the work surface effectively precludes use of that area of the work surface for office work. Since access to space by lifting panel may be required at any time to connect or disconnect electrical cables to the outlets, an office worker would have to move any objects placed on panel to access space. Further, the Wilson et al disclosure requires complex manufacturing processes to produce a desk top having the proper cutout space to accommodate the power and communication module.

Another approach is to mount utility service in a wall immediately adjacent to the work surface, as disclosed in U.S. Pat. No. 4,603,229 (Menchetti) which shows an office environment having a suspended ceiling, wall panels, and a false wall panel behind which are located a telephone outlet module and an electrical service receptacle. Electrical power is routed to the sides of the modules by wiring placed behind the false wall panel in the cavity of the wall structure. However, using the arrangement disclosed by Menchetti requires that the vertical wall surface be located immediately adjacent to the work surface or desk, an arrangement which may be undesirable to some office workers and office furniture designers.

Finally, attempts have been made to facilitate wiring near or within a desk surface by providing a wiring support located immediately below the work surface, as disclosed in U.S. Pat. No. 3,114,584 (Wilmer). However, the wiring support of Wilmer does not fully enclose the wires or cables, but merely supports them on an elongated terminal block using brackets installed beneath the desk. This arrangement is undesirable in some office environments, since exposed wiring may be jostled, disturbed, or even severed.

Thus, there is a need for an apparatus for supporting and locating electrical service outlets immediately adjacent to and conveniently located near an ergometric work surface or desk top. The present invention is directed toward fitting that need.

SUMMARY OF THE INVENTION

The present invention comprises a fully enclosed structural support stanchion for modular furniture having an internal cavity which may receive standard modular office furniture electrical service cabling, and which is provided with a demountable front accessory panel to which plural electrical or electronic accessories may be mounted, such that a portion of the accessory extends into the stanchion and can releasably connect either to one end of the standard modular furniture electrical service cabling or to the building electrical system.

The stanchion is constructed with rigid materials so that it can act as a support for an overhead bookshelf or other storage facility, and the stanchion is further provided with a large internal storage cavity into which small office supplies or other articles may be placed and stored behind a hinged, selectively closable door. The stanchion further includes an elongated bracket support which may receive standard shelf brackets, permitting the stanchion to act as a cantilever support for structures such as a shelf secured to the shelf brackets.

The stanchion is preferably constructed in a right triangular vertical columnar configuration including a rigid frame having vertically elongated rigid frame panels secured at a right angle, top and bottom plates each resembling a right isosceles triangle. A front-facing opening is provided in the base plate to enable the plate to clear and receive an electrical cabling system.

The entire interior of the stanchion is hollow, enabling the interior to receive both the electrical cabling system and demountable accessories which are joined to the cabling system using a novel mounting bracket.

The electrical cabling system comprises a conventional cable and a modular connector shell secured to a rigid back plate and a mounting bracket which receives a modular electrical receptacle. The mounting bracket enables the modular, demountable receptacle to be simultaneously mechanically mounted on the bracket and electrically connected to the cable connector shell. The mounting bracket and the base plate of the stanchion are provided with axially aligned holes to receive conventional fasteners such as bolts for securing the mounting bracket, and the base plate, to the base unit or desk.

The stanchion frame members define a right isosceles triangular cavity within the interior of the stanchion. The frame members further include outward-facing substantially "C" shaped columns secured to their free ends. The "C"-shaped columns are provided with outward-facing narrow, elongated faces which provide securement means for plural front facia panels. Preferably, three facia panels are used: a top panel, middle panel, and bottom panel. The middle and bottom panels are demountable, and may be fitted with various accessories depending upon the desires of the office worker. For example, the middle panels may be used in conjunction with a telephone, clock, fan, air purifier, pencil holder, tablet holder, and similar accessories; and the bottom panels may be used in conjunction with electrical receptacles, telephone power receptacles, and similar accessories.

The stanchions include an elongated, vertical bracket to which plural accessories may be secured in cantilever fashion. For example, a conventional shelf or like device may be secured to a pair of spaced-apart stanchions such that the shelf joins the stanchions which act as opposing supports for the shelf.

Accordingly, it is a primary object of the present invention is to provide a compact, aesthetically pleasing, unitary support stanchion and electrical service module which provides structural support for modular office furniture components and also permits selective connection of plural electrical or electronic accessories either to the stanchion electrical service outlets or to the building electrical system.

A further object of the present invention is to provide unitary modular furniture support stanchions having fully-enclosed electrical service cables and outlets which permit placement of the modular furniture in any desired position within an office environment.

Still a further object of the present invention is to provide an electrical service outlet mountable within a modular furniture structural support stanchion which may be rapidly and easily connected or disconnected to standard modular furniture electrical service cables.

Yet another object of the present invention is to provide a plurality of electrical and electronic accessories which may be quickly and easily mounted and demounted from a modular furniture support stanchion and from the internal cable or wiring harness mounted within the stanchion.

BRIEF DESCRIPTION OF THE DRAWINGS

The foregoing invention, as described and claimed fully below, may be constructed in plural embodiments of which one preferred embodiment is shown in the accompanying drawings of which:

FIG. 15 is a front view of a stanchion of the present invention showing an air purifier accessory mounted therein.

FIG. 16 is a cross-sectional view taken along line 16—16 of FIG. 15.

DETAILED DESCRIPTION OF THE PREFERRED EMBODIMENTS

In the following detailed description of the preferred embodiments of the present invention, specific terminology is used for the sake of clarity. However, the present invention is not intended to be limited to embodiments incorporating only structures designated by the particular terminology used; the invention includes all technical equivalents for accomplishing a substantially similar purpose in a substantially similar way.

Figure 1:
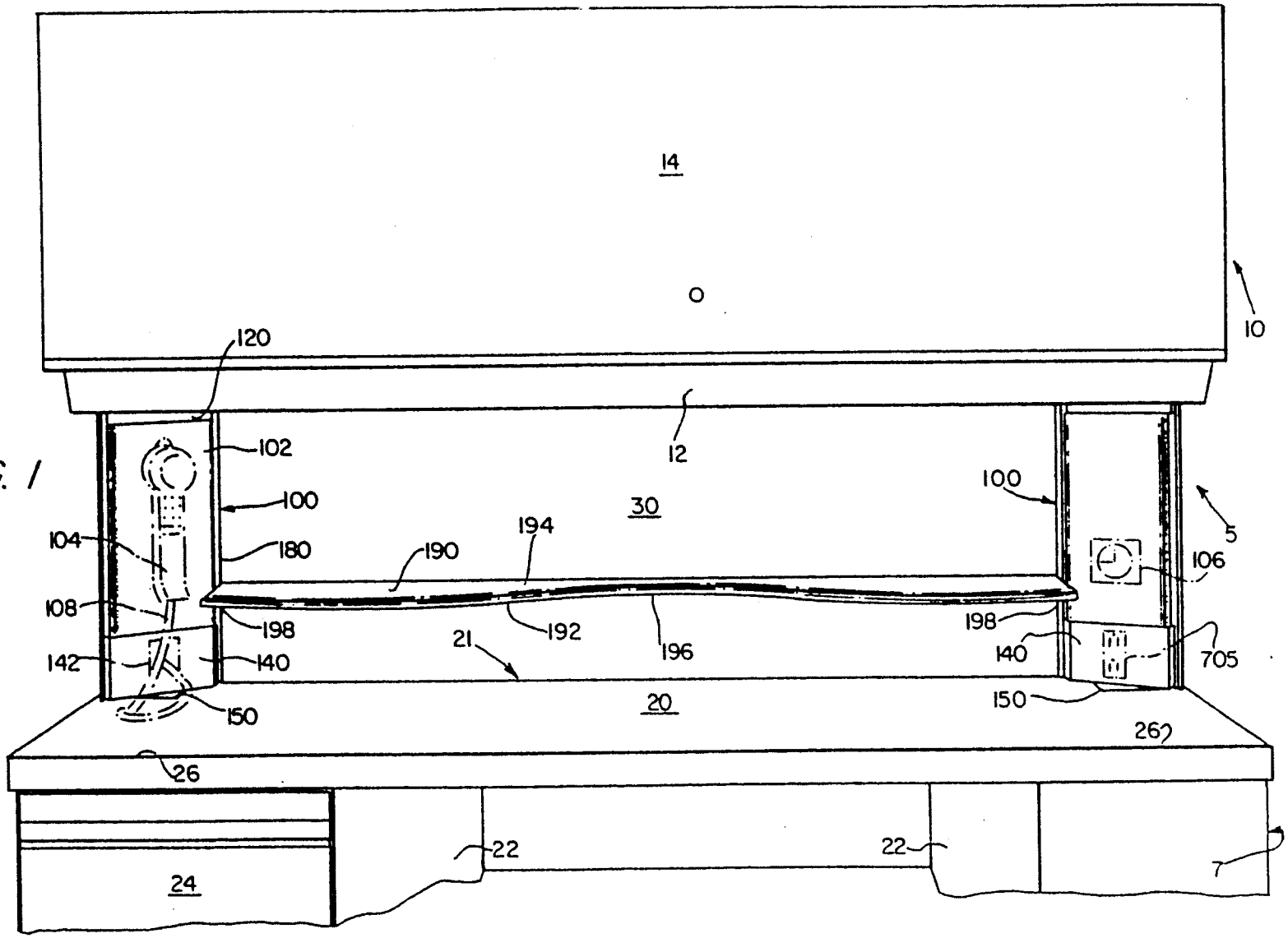
FIG. 1 is a front perspective view of a desk and work surface incorporating two corner support stanchions according to the present invention and an overhead storage compartment mounted on the stanchions.

Referring now to the preferred embodiment of the invention shown in FIGS. 1 through 16, and referring specifically to FIG. 1, a furniture system 5 is shown which incorporates two stanchions 100 according to the present invention. The system of FIG. 1 includes an overhead shelf or storage unit 10 supported by two vertical stanchions 100 which rest on and are interconnected to a horizontal work surface 20 of a desk 21.

The work surface 20 may comprise one part of a desk or modular furniture system 7, and in the embodiment of FIG. 1, work surface 20 is shown supported by twin pedestals 22 one of which includes a file drawer 24. Further, the storage unit 10 may include a lower fascia panel 12 and a hinged door 14 for access to the interior of unit 10. However, a stanchion 100 according to the present invention may be employed with any furniture system which includes an overhead portion such as unit 10 of FIG. 1 and a lower portion such as work surface 20 and supporting pedestals 22.

As FIG. 1 readily indicates, use of the stanchions 100 to support an overhead unit 10 leaves a large lateral open space 30 through which adjacent office workers may communicate or which may face an office window. Thus, the stanchions 100 preclude the need for a back structural panel or other support means for an overhead unit 10 when a unit 10 is combined with a desk or other work surface.

FIG. 1 further illustrates that the stanchions 100 are preferably constructed using a "clean" exterior design incorporating front panel 102, top panel 120, and bottom accessory panel 140. Panel 102 is preferably made of plastic. As indicated in FIG. 1 and as shown in detail in FIGS. 3, 5, and 6, the stanchions 100 are generally triangular in cross-section, such that panels 102, 120, and 140 are mounted at an inwardly-facing 45 degree angle with respect to the front edge 26 of work surface 20. When the stanchions 100 form part of an office furniture system such as a desktop and an overhead shelf, the 45 degree angle causes the stanchions 100 to face a worker seated at the desk and facilitates access to the stanchions 100.

The discussion below contains a detailed description of the electrical power routing system employed in conjunction with the stanchions 100. Such electrical power cabling and associated apparatus is concealed within the stanchions 100 and thus is not visible in FIG. 1. However, FIG. 1 shows several electrical and electronic accessories, such as telephone handset 104, clock 106, and electrical receptacle 705, which may be connected to the stanchions 100 using the internal power routing system. The power routing system terminates in a connector concealed behind panel 140, and a hole is provided in panel 140 so that electrical accessories may mate with the appropriate concealed receptacle or connector. The dimensions and placement of the hole within panel 140 vary depending upon the accessory employed. For example, when connection to a telephone handset 104 is desired, panel 140 is provided with a telephone power receptacle 142 mounted in panel 140 to which the handset cable 108 is secured. Other accessories, such as electrical receptacle 705, are mounted directly in panel 140 using a hole of appropriate size.

Any number of office accoutrements may be connected to or secured within panels 102 and 140 and supplied with power either from the power cables concealed within the stanchions 100 or from the building electrical circuitry. By way of example only, such accessories may include a telephone, clock, personal fan, a household-voltage electric power outlet, and other items. As shown in FIG. 1, for example, a clock 106 can be mounted directly in panel 102. The electrical cord and plug of clock 106 can then be connected to one of the building outlets through structure in stanchions 100 and desk 21 which will be described in detail hereinafter.

Figure 4:
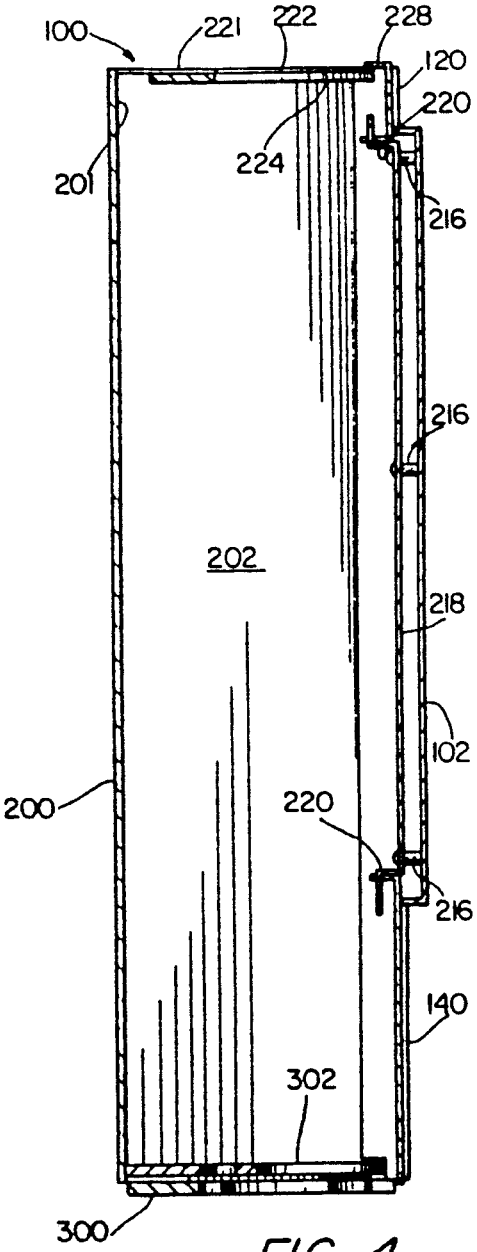
FIG. 4 is a cross-sectional view taken along line 4—4 of FIG. 3.
Figure 3:
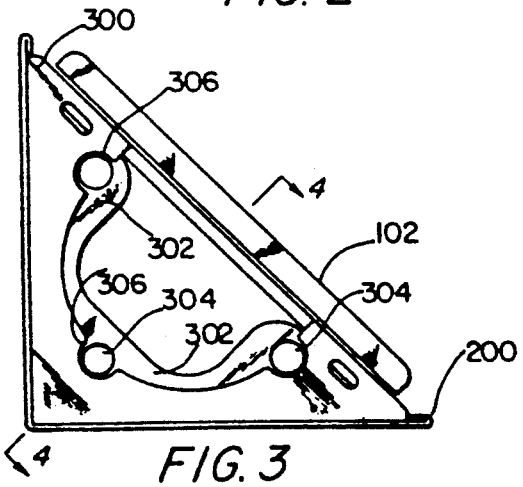
FIG. 3 is a bottom plan view of the stanchion of FIG. 1.
Figure 5:
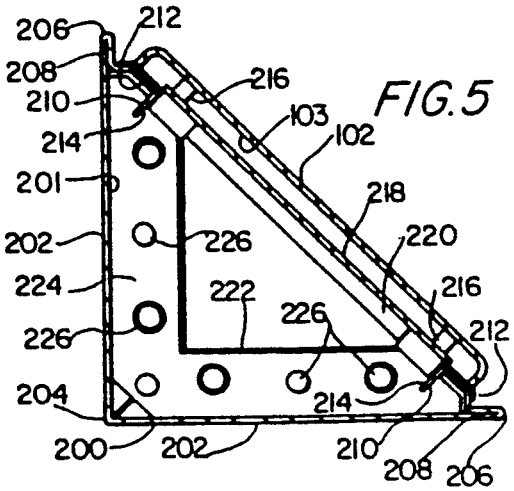
FIG. 5 is a cross-sectional view taken along line 5—5 of FIG. 2.
Figure 6:
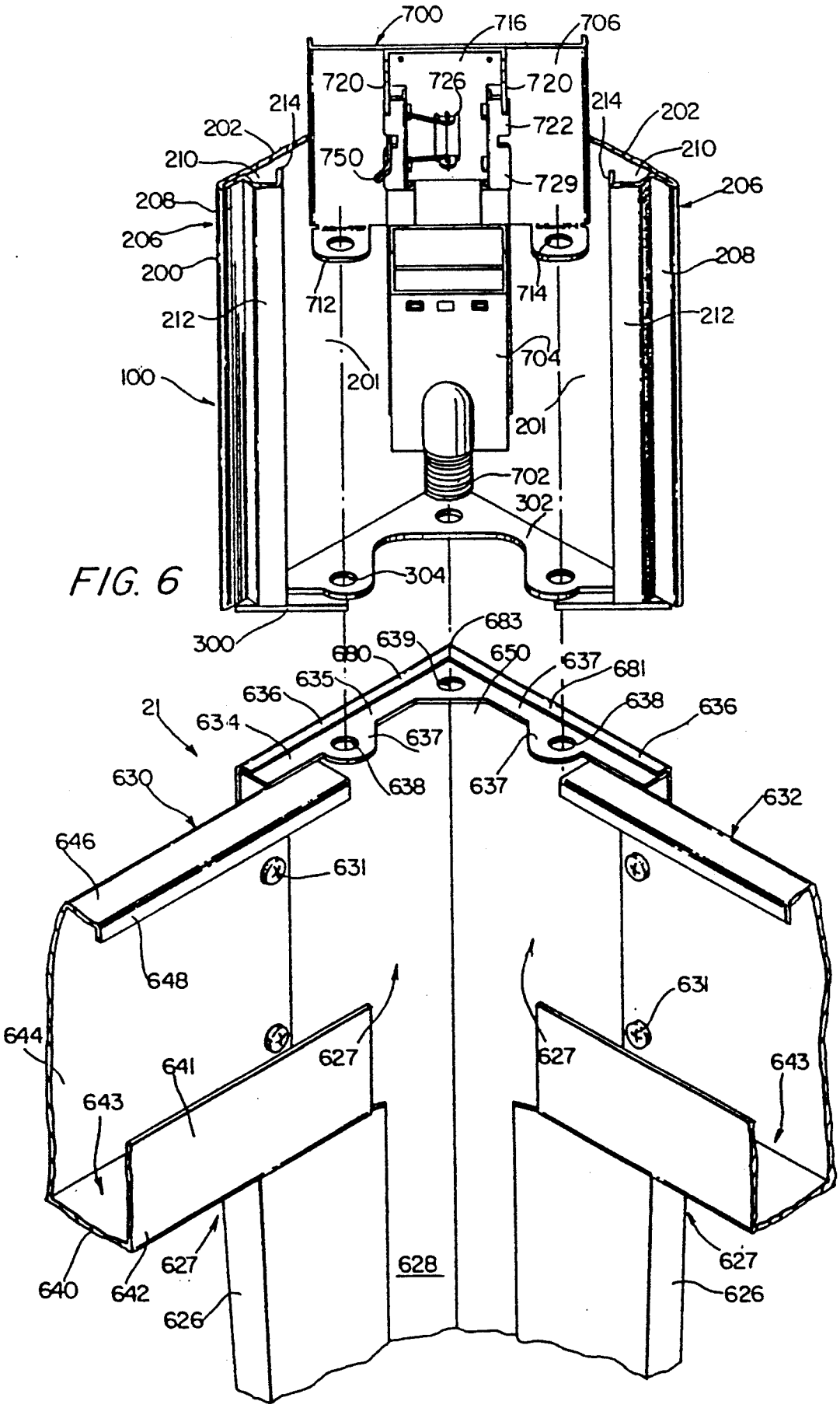
FIG. 6 is a front perspective view of the bottom interior portion of the stanchion of FIG. 1 additionally showing the internal mounting structure of modular furniture to which the stanchion may be secured.

FIGS. 2 through 6 show the structural details of the stanchion 100. A frame 200 is provided, preferably constructed of formed or extruded metal such as 16 gauge rolled sheet steel. Other material may be used if the material has sufficient structural strength to support an overhead furniture article such as the unit 10 shown in FIG. 1. As shown in FIG. 5, the frame 200 is formed in a generally symmetrical right triangular column, a partial perspective view of which is shown in FIG. 6. Twin, symmetrical back structural panels 202 are provided and are unitarily connected at vertically-oriented right angle bend 204 to form the single unitary frame member 200.

Panels 202 each include symmetrically identical vertical end portions 206 which are folded and formed into an inward facing channel 210 which provides additional structural strength and rigidity. These end portions 206 thus include a short double-thickness wall portion 208 which acts as a rigid vertical column, enhancing the strength of the stanchion 100. Immediately inboard of these double-thickness walls 208 are provided formed channels 210. In addition to providing vertical strength, the vertical channels 210 include an outwardly facing surface 212 to which panel 102 is secured.

As further shown in FIG. 5, the panel 102 is fitted between the inward-facing surfaces 214 of channels 210. To accomplish the fitted arrangement, the inner surface 103 of panel 102 is secured using plural fasteners 216 to an inner front panel 218. In a preferred embodiment as shown in FIGS. 4 and 5, six fasteners 216, which may be conventional rivets, threaded fasteners, or other securement means of known design, are used. Panel 218 includes a metal flange 220 secured to the lower inner face of panel 218, and the ends of flange 220 are fitted against surfaces 214 of channels 210. As shown in FIG. 4, two flanges 220 are provided, one mounted at the top of the inner panel 218 and one along its bottom edge. The flanges 22 further interfit with top panels 120 and bottom panel 140 using a friction fit.

The structure of the top and bottom ends of the stanchion 100 are now described, with specific reference to FIGS. 2 through 6. Details of the top end of stanchion 100 are shown in FIGS. 4 and 5. The top end of a stanchion 100 is formed using inner angle plate 224. The inner angle plate 224 is secured to the inward facing surfaces 201 of back panels 202 using conventional securement means such as welding. The top outer panel 120 is secured to the top surface 221 of panel 222 by means of an inwardly extending lip 228 which is secured at right angles to the top of the front surface of panel 120, as shown in FIG. 4. Panel 224 is provided with plural securement holes 226 shown in FIG. 5, which enable panels 224 and 222 to be secured to an overhead storage unit such as unit 10 of FIG. 1. The exact location and size of holes 226 is not critical, and is generally dependent upon the physical structure of the overhead unit 10, which may vary depending upon the particular furniture configuration in which the stanchions 100 are used.

The structure of the bottom portion of a stanchion 100 is shown in detail in FIGS. 2, 3, 4 and 6. The exact structure and interconnection of parts forming the base of a stanchion 100 is not critical, provided that the base provides sufficient structural strength and rigidity to enable reliable securement to free-standing furniture such as desk 21 of FIG. 1. In a preferred embodiment shown in FIGS. 2 through 6, the bottom portion of stanchion 100 has parts and structural relationships determined, in part, by the parts and structures of the supporting framework of desk 21. As shown in FIG. 6, a desk 21 may include a supporting structure including plural legs 626 having lower ends (not shown) seated on the floor of an office, and upper ends 627. Seated upon and secured to the top ends 627 of legs 626 are a first structural C-channel 630 and a second structural C-channel 632. Channels 630 and 632 are symmetrically identical, and comprise a base plate 640, a raceway channel plate 641 secured at right angles to plate 640 on the inward-facing side of channel 630, a joist plate 644, a top plate 646 secured at right angles to the joist plate 644, and a downwardly extending. elongated lip 648 secured at right angles to top plate 646. In combination, the joist plate 644, the bottom plate 640, and the race way channel plate 642 form a U-shaped raceway 643 useful for retaining and concealing electrical power cabling and other wiring. The top plate 646 provides a relatively broad, flat surface to which a desk top work surface 20 may be secured.

Ends 627 are secured to channels 630 and 632 using conventional securement means such as screws 631. Ends 627 and channels 630 and 632 are further joined using a stanchion securement plate 634; the plate 634 comprises two elongated, flat legs 635 and 637 joined at a right angle.

An angled reinforcement strip 636, comprising two "L"-shaped legs 680 and 681 secured at a right angle at point 683, is secured to plate 634 and the rear surface of ends 627. This reinforcement strip 636 provides additional surface area for securing plate 634 to web plate 628, thus ensuring that plate 634 will not be prone to slippage or misalignment as a result of the large structural stresses placed upon it by overhead unit 10. Extending inward from plate 634 are two symmetrically identical tabs 637 which provide surface area through which securement holes 638 may be drilled. A rear securement hole 639 is also provided in plate 634 at the point where legs 635 and 637 meet. When the stanchion 100 is secured to plate 634, holes 638 and 639 are placed in axial alignment with corresponding holes provided in the bottom plate of the stanchion 100, and suitable threaded fasteners or other securement means are used to join the bottom plate of the stanchion 100 and plate 634.

Other configurations of plate 634 ma be used to accomplish substantially similar purposes, but any desired configuration of plate 634 must include a cut-out cable clearance space 650 as shown in FIG. 6. As the detailed discussion indicates below, the space 650 provides clearance space for electrical power cabling to extend through plate 634 and into the interior of a stanchion 100.

Base plate 300 is secured to the bottom surfaces of channel 212 and double-thickness wall 208 of the columns 210. Conventional securement means such as welding is used. An inner base plate 302 is secured to the top surface of plate 300; the plate 302 is secured to the interior surfaces of frame 200. Plate 302 is drilled with plural securement holes 304 which may be placed in axial alignment with hole 638 and 639 to facilitate securing the stanchion 100 to plate 634 of desk 21. Plate 300 is not drilled with corresponding holes, but rather is provided with plural semi-circular fastener clearance cutouts 306 which enable fasteners protruding through plate 304 to clear plate 300.

Electrical power is supplied to the interior of the stanchion 100 and to accessories connected to the stanchion 100 using a novel combination of electric cable connection and accessory fasteners apparatus 700 shown in FIGS. 7 through 12. The apparatus 700 comprises four main assemblies: an electrical power cable 702 which protrudes upward through space 650 in plate 634 from the base of desk 21; a modular electric power connector 704; a modular electrical receptacle 705; and a mounting plate 706.

The electric power cable 702 is preferably a conventional 8-wire cable such as that commercially available from Pent, Inc. and is unitarily mated to connector 704 which is also commercially available from Pent, Inc., cable 702 and connector 704 together being identified as Pent Inc. part number 225281. The receptacle 705 which is plugged into connector 704 is also conventional and is a stock part commercially available from Pent, Inc. as part number 225169. Receptacle 705 can incorporate a surge protector. Such a receptacle with an integral surge protector is a stock part commercially available from Pent, Inc. as part number 225079. As will be appreciated by those of skill in the art, other features can be incorporated in conventional manner into receptacle 705, such as an emergency light.

Figure 7:
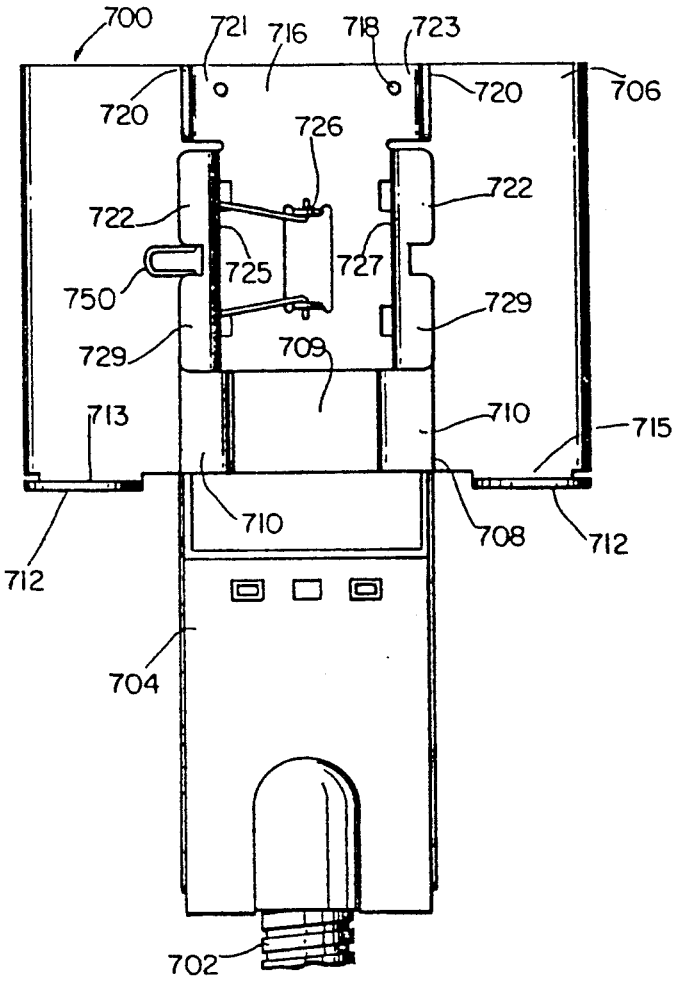
FIG. 7 is a front elevation view of the interior bottom portion of a stanchion of FIGS. 1 through 6, additionally showing part of a standard modular furniture cable connector used to supply power to the stanchion power outlets.
Figure 8:
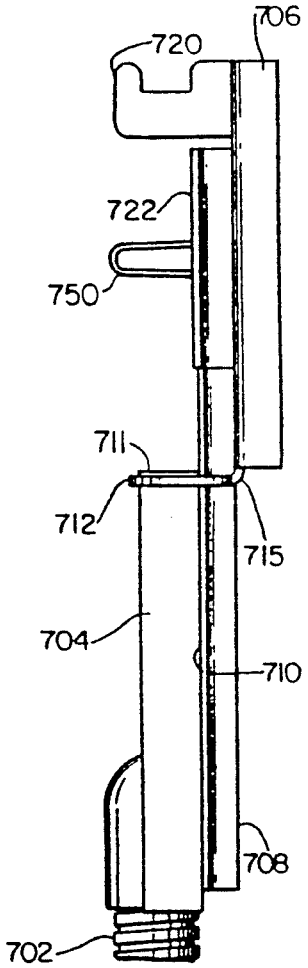
FIG. 8 is a side elevation view of the structure of FIG. 7.
Figure 9:
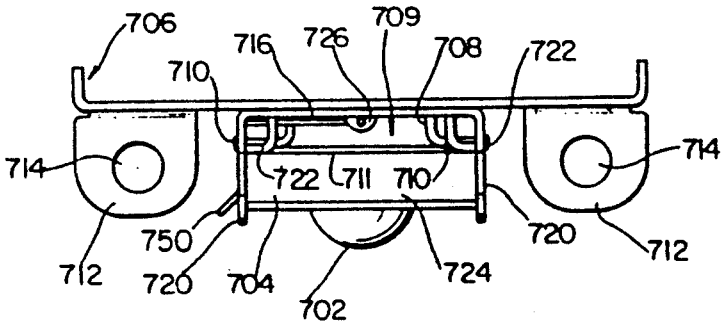
FIG. 9 is a top plan view of the structure of FIGS. 7 and 8.
Figure 10:
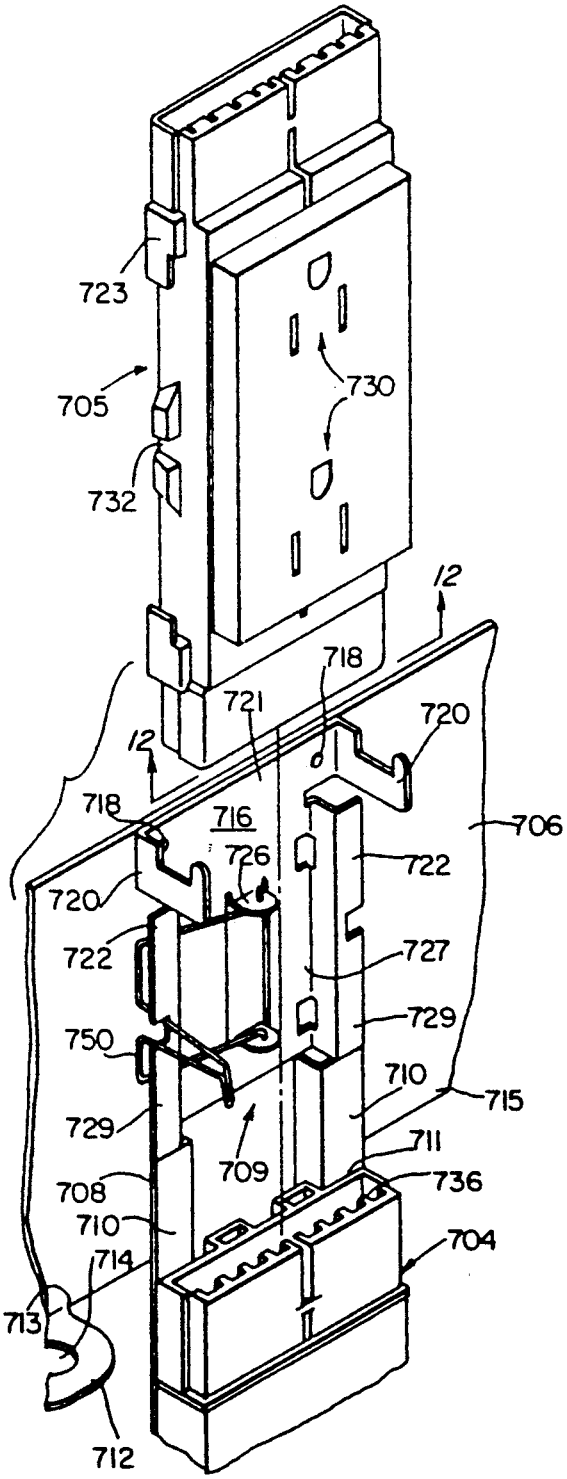
FIG. 10 is an exploded perspective view of the structures of FIGS. 7 and 8, shown with a mating modular electrical receptacle.
Figure 11:
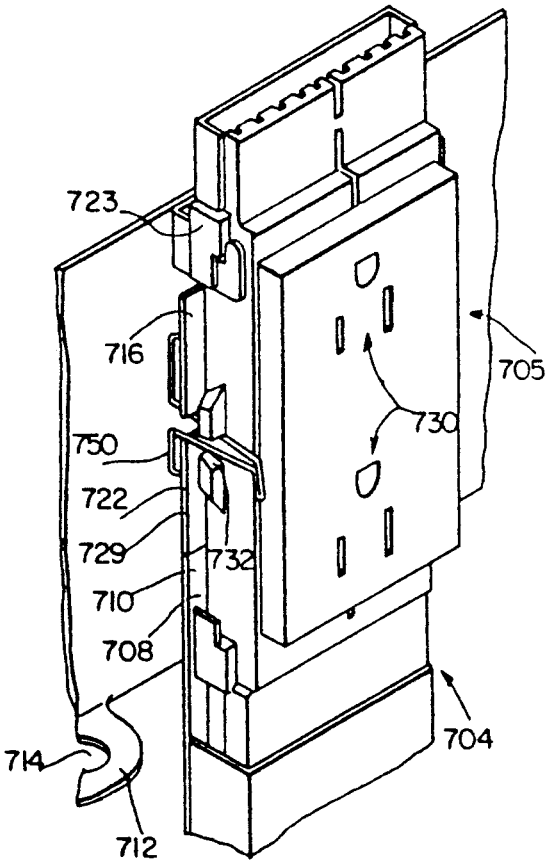
FIG. 11 is a perspective view of the structures of FIG. 10, assembled.
Figure 12:
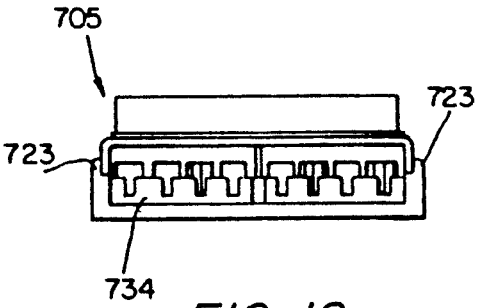
FIG. 12 is a cross-sectional view taken along line 12—12 of FIG. 10.

The mounting plate 706 comprises plural parts shown in detail in FIGS. 7 through 10. The connector 704 is secured to plate 706 using a rectangular elongated connector bracket 708. As shown in FIGS. 7, 9, and 10, the bracket 708 comprises a center channel 709 and two outwardly facing mounting arms 710. The rear surface 711 of connector 704 is secured to the outward facing surfaces of arms 710 using conventional fastening means, such as rivets or other fasteners. When the connector 704 is secured to bracket 708, the two parts form a unitary structure such that the cable 702 is protected from excessive strain caused by twisting or elongation of the cable.

The bracket 70 is secured to the interior of the stanchion 100 using two fastener tabs 712 which are secured at right angles to the lower ends 713 and 715 of plate 706. Each tab 712 is provided with a fastener hole 714; the plate 706 is secured to plate 304 of the stanchion 100 by placing holes 714 and holes 304 in axial alignment and inserting appropriate fasteners (not shown). Such fasteners may include conventional threaded fasteners such as bolts.

Receptacle 705 is secured to plate 706 using accessory bracket 716. Bracket 716 is secured to plate 706 using plural conventional fasteners 718, such as rivets. The bracket 716 includes two mounting ears 720 extending from its sides at vertical right angles at its upper end 721; receptacle 705 may be secured to the ears 720 using complementary ears 723 which provide a complementary press-fit and hanging arrangement with mounting ears 720. Two accessory abutment brackets 722 are provided and are mounted at right angles parallel to the left and right vertical edges 725 and 727 of bracket 716. The brackets 722 include outwardly facing abutment surfaces 729 against which receptacle 705 can be placed to ensure that receptacle 705 faces outwardly of the stanchion parallel to a vertical plane.

Receptacle 705 is provided with duplex outlets 730 for receiving a conventional plug. As shown in FIG. 1, panel 140 can be provided with an aperture to allow duplex outlets 730 to protrude therethrough. Thus, the rear of an accessory such as a clock 106 can be provided integrally with a conventional two or three-pronged plug (not shown), which plug can be inserted into one of duplex outlets 730. Alternatively, the rear of an accessory such as a clock 106 can be provided integrally with a receptacle similar to receptacle 705 for directly mating to connector 704 in the same manner as receptacle 705. In another alternative, an accessory such as a clock 106 can be conventionally provided with an electrical cord and two or three-pronged plug (not shown), which plug can be inserted into one of duplex outlets 730 for routing power from cable 702 to clock 106.

To retain receptacle 705 in place and provide releasable, demountable securement to bracket 716, a spring clip mount 726 is provided and is secured to the inward-facing face of bracket 716. A pivotable spring clip 750 is attached to mount 726 which releasably engages a locking slot 732 provided at one side of receptacle 705, thus releasably securing receptacle 705 to bracket 716. Thus, a receptacle 705 may be secured to bracket 716 by mating its electrical reception connector 734 with mating electrical plug 736 in the top portion of connector 704, and by engaging spring clip 750 with locking slot 732. Receptacle 705 will then snap into place against abutment bracket 722, thereby releasably securing receptacle 705 in a fixed, vertically oriented position and simultaneously electrically connecting it to cable 702 through connector 704.

Figure 2:
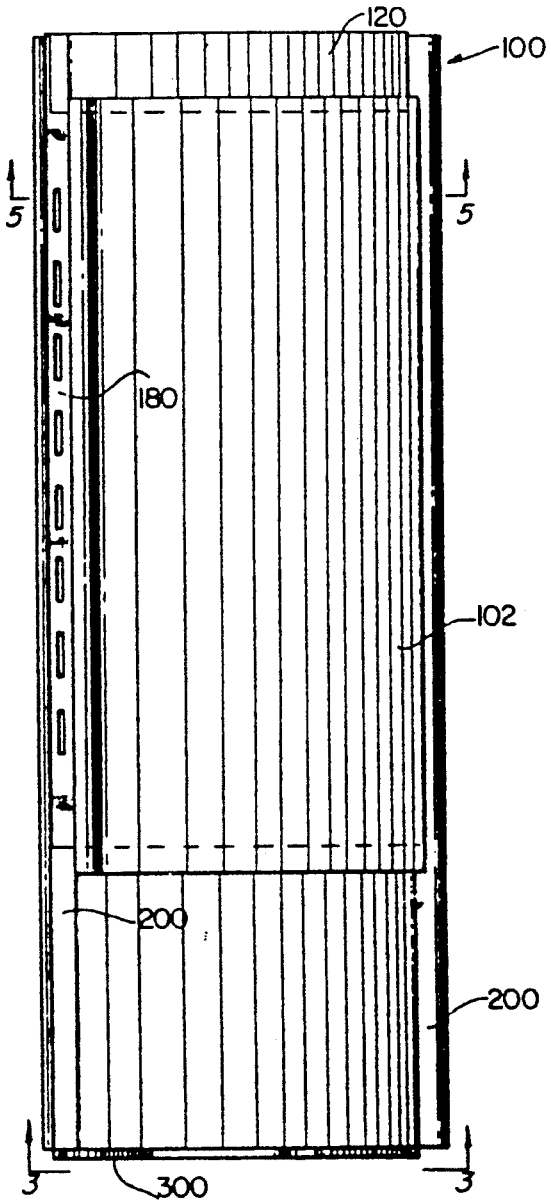
FIG. 2 is a front elevation view of one of the stanchions of FIG. 1.

As shown in FIGS. 1 and 2, the present invention includes an elongated support bracket 180 mounted along the edge of the rear frame 200. The bracket 180 resembles a standard shelf bracket, and may be used to support a variety of accessories. In a preferred embodiment shown in FIG. 1, the bracket provides support for a shelf 190 which extends between the two stanchions 100 shown in FIG. 1, running parallel to work surface 20. As shown in FIG. 1, the shelf 190 is provided with an undulating or curved front edge 192 and a straight rear edge 194. The curvature of the front edge 192 of the shelf 190 is determined by the proximity of an office worker's chair to the shelf 190. Thus, the shelf 190 is curved inwardly most deeply at the point 196 where an office worker will sit most close to the shelf 190. The curvature diminishes at the ends 198 of the shelf, which are further away from the office worker's typical seat position. This arrangement effectively moves items placed on the ends 198 of the shelf 190 closer to the office worker, while preventing the shelf 190 from interfering with work operations close to the office worker's typical seat position.

Figure 13:
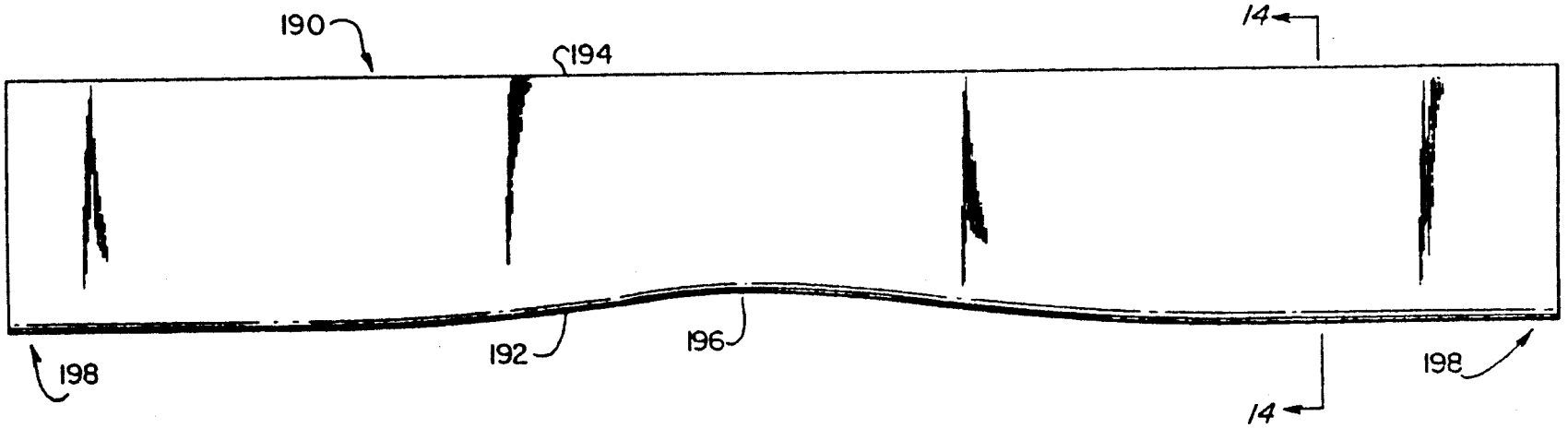
FIG. 13 is a top plan view of the shelf shown in FIG. 1.
Figure 14:
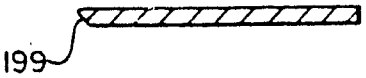
FIG. 14 is a cross-sectional view taken along line 14—14 of FIG. 13.

Moreover, the shelf 190 is provided with a downwardly beveled front edge 199, shown in FIG. 13. This beveled front edge 199 creates a visual illusion that the shelf 190 is thinner than it actually is. When viewed from a standing position, an observer sees the beveled edge 199 of the shelf 190 rather than the full cross-section of the shelf 190. Thus, a standing observer will perceive that the shelf 190 is thinner than it actually is.

The accessories which may be used in conjunction with the stanchion 100 include accessories occupying only the interior cavity of the stanchion behind panel 140, and larger accessories which also occupy some of the space behind panel 102. An example of the latter type of accessory is the fan and air purification system shown in FIGS. 15 and 16. The fan system 800 includes an air intake filter 802 through which ambient air is drawn by action of motor 804 and fan blades 806 coupled to the motor shaft 808. The air flow created by motor 804 and fan blades 80 is directed out the stanchion through a louver system 810 comprising a plurality of coupled, simultaneously-movable louver panels 812 mounted behind louver housing 814. The louver panels 812 are coupled together in a conventional manner so that panels 812 may be simultaneously rotated left or right to adjust the volume and direction of air flow using louver actuator lever 816. Controls 818 and 820 are provided to enable an office worker to selectively apply power to motor 804 using control 818 and to adjust the speed of motor 804 using control 820 in order to control the airflow rate of the system 800.

As further shown in FIG. 16, each of the louver panels 812 comprises a vertically elongated louver blade 820 having a center pivot 822 and a securement hole 824 provided in a semi-circular inwardly-extending tab 826. Each hole 824 of each blade 820 is interconnected in conventional form, using wire or other rigid connection means, so that moving one blade 820 from the closed position to the open position 828 shown in FIG. 16 will cause all of the blades 820 to simultaneously pivot about point 822 and thereby move to the entirely open or entirely closed position.

Many modifications and variations of the present invention are possible in light of the above teachings and specification. It is therefore to be understood that, within the scope of the appended claims, the invention may be practiced otherwise than as specifically described.

What is claimed is:

1. A furniture system including a base unit and an overhead unit and at least one stanchion, said base unit including:

(a) plural support means for supporting said base unit upon a floor, each said support means including an upwardly facing top securement surface;

(b) stanchion securement means secured to each said top securement surface for fastening said support means to said stanchions, said securement means including plural securement holes;

(c) a base unit frame comprising plural elongated structural members each having two ends each secured to one of said support means;

(d) a planar work surface secured to said base unit frame;

said stanchion including:

(e) first and second elongated frame panels each having two longitudinal side edges, one top edge, and one bottom edge, said first frame panel being secured to said second frame panel at a right angle along one longitudinal edge of said first and second frame panels;

(f) a top end plate having a hypotenuse edge and first and second side edges secured to said top edges of said first and second elongated frame panels;

(g) a bottom end plate comprising two bottom plate arms secured at a right angle, said bottom plate arms being secured to said bottom edges of said first and second elongated frame panels, said bottom end plate including (i) a cable clearance space disposed between said bottom plate arms; and (ii) plural securement holes in said bottom panel arms disposed in alignment with said holes in said stanchion securement means;

(h) a rectangular top front panel having side edges secured to one longitudinal edge of each of said first and second frame panels, and having a top edge secured to said hypotenuse edge;

(i) a middle front panel secured to one longitudinal edge of each of said first and second frame panels below said top front panel;

(j) a bottom accessory panel secured to one longitudinal edge of each of said first and second frame panels below said middle front panel; and (k) accessory power means secured to said bottom end plate for supplying electricity to an accessory demountably secured in said stanchion, said power means comprising:

(i) an electrical supply cable axially aligned with said stanchion;

(ii) electric power connector means for connecting said cable to the accessory demountably secured in said stanchion, said connector means having a first end electrically and mechanically coupled to said supply cable, a second end including plural electric contact means for demountable connection to the accessory demountably secured in said stanchion, and fastening means for fastening said connector means to said stanchion; and (iii) accessory mounting means for demountably securing the accessory simultaneously to said stanchion and said electric power connector means; and said overhead unit including a bottom surface supported by said stanchion and secured to said top end plate.

2. The furniture system of claim wherein said accessory mounting means for demountably securing the accessory simultaneously to said stanchion and said electric power connector means comprises:

(a) an elongated rectangular planar bracket comprising:

(i) a rectangular bracket body;

(ii) two fastener tabs secured at right angles to said bracket body, said fastener tabs each including a fastener hole for receiving a fastener;

(iii) a channel bracket including two outwardly-facing mounting arms each secured to said power connector means;

(b) an accessory abutment bracket secured to said bracket body and including:

(i) two spaced-apart outwardly facing mounting ears each having a notch for receiving a portion of one of said accessories;

(ii) two elongated, spaced-apart outwardly facing abutment faces for receiving part of a body of one of said accessories, the spaces separating said mounting ears and said abutment faces being axially aligned and defining a clearance recess for receiving a body of one of said accessories; and (c) spring clip mounting means for demountable receiving a spring clip for demountable securement to one of said accessories.

3. The furniture system of claim 1, wherein said fastening means for fastening said connector means to said stanchion comprises an elongated rectangular planar bracket including:

(a) a rectangular bracket body;

(b) two fastener tabs secured at right angles to said bracket body, said fastener tabs each including a fastener hole for receiving a fastener; and (c) a channel bracket including two outwardly-facing mounting arms each secured to said power connector means.

4. The furniture system of claim wherein said electric power connector means secured to said cable and to said stanchion for supplying power to said accessories comprises a rigid connector shell including terminal means for connection to said cable, and plural laterally spaced-apart electric contacts in said shell.

5. The furniture system of claim 1, wherein said stanchion securement means secured to said top securement surface for fastening said support means to said stanchions comprises:

an angle plate comprising two angle plate arms joined at a right angle, each plate arm including an inwardly extending fastener hole tab;

a fastener hole in said angle plate; and a tab fastener hole in each of said fastener hole tabs.

6. The furniture system of claim 1, wherein said plural support means secured to said base unit for supporting said base unit upon a floor comprise plural elongated legs.

7. A furniture system including a base unit and an overhead unit and at least one stanchion, said base unit including:

(a) plural support means for supporting said base unit upon a floor and including an upwardly facing top securement surface;

(b) stanchion securement means secured to said top securement surface for fastening said support means to said stanchions, said securement means including plural securement holes;

(c) plural base unit frame members each having two ends each secured to one of said support means;

(d) a desktop secured to said frame members; said stanchion including:

(e) a unitary right-angle frame including two longitudinal side edges, a top edge, and a bottom frame;

(f) a top end plate secured to said frame;

(g) a unitary right-angle bottom end plate secured to said frame, said bottom end plate further including a cable clearance space disposed in said bottom plate and plural securement holes in said bottom end plate in alignment with said holes in said stanchion securement means;

(h) a top front panel having side edges secured to said frame, and having a top edge secured to said top end plate;

(i) a middle front panel secured to said frame below said top front panel;

(j) a bottom accessory panel secured to said frame below said middle front panel;

(k) accessory power means secured to said bottom end plate for supplying electricity to an accessory in said stanchion, said power means comprising:

(i) an electrical supply cable;

(ii) electric power connector means for connecting said cable to the accessory in the stanchion, said connector means having a first end coupled to said supply cable, and a second end including plural means for demountable electrical connection to the accessory in the stanchion; and (iii) accessory mounting means for demountably securing the accessory simultaneously to said stanchion and said electric power connector means; and said overhead unit including a bottom surface supported by said stanchion and secured to said top end plate.

8. A furniture system including a base unit and an overhead unit and at least one stanchion, said base unit including:

(a) stanchion securement means for fastening said stanchions to said base unit, said securement means including plural securement holes;

(b) a work surface secured to said stanchion securement means;

said stanchion including:

(c) a unitary right-angle frame including two longitudinal side edges, a top edge, and a bottom edge;

(d) a top end plate secured to said frame;

(e) a unitary right-angle bottom end plate secured to said frame, said bottom end plate further including a cable clearance space disposed in said bottom plate and plural securement holes in said bottom end plate in alignment with said holes in said stanchion securement means;

(f) a top front panel having side edges secured to said frame, and having a top edge secured to said top end plate;

(g) a middle front panel secured to said frame below said top front panels;

(h) a bottom accessory panel secured to said frame below said middle front panel;

(i) accessory power means secured to said bottom end plate for supplying electricity to an accessory in said stanchion, said power means comprising:

(i) an electrical supply cable;

(ii) electric power connector means for connecting said cable to the accessory in the stanchion, said connector means having a first end coupled to said supply cable, and a second end including plural means for demountable electrical connection to the accessory in the stanchion; and (iii) accessory mounting means for demountably securing the accessory simultaneously to said stanchion and said electric power connector means; and said overhead unit including a bottom surface supported by said stanchion and secured to said top end plate.

9. A furniture system comprising:

(a) a base unit;

(b) an overhead unit; and (c) at least two spaced vertical stanchions supporting said overhead unit above said base unit, each of said stanchions including:

(i) a frame having top and bottom ends and first and second vertical panels, each of said panels having a forward edge and a rearward edge, said first and second panels being joined at an angle at their rearward edges and forming a substantially right angle bend, said forward edges defining a front-facing opening therebetween; and (ii) panel means removably secured to said forward edges of said panels, said panel means including accessory mounting means for demountably securing an accessory in said front-facing opening and electric power connector means for connecting a source of electric power to the accessory.

10. The furniture system of claim 9, wherein each of said stanchions further includes a bottom plate secured to said bottom end of said frame, said bottom plate securing said stanchion to said base unit.

11. The furniture system of claim 9, wherein each of said stanchions further includes a top plate secured to said top end of said frame, said top plate securing said overhead unit to said stanchion.

12. The furniture system of claim 9, further comprising:

(d) an electrical supply cable axially aligned with each of said stanchions, said cable being selectively connectable to said connector means.

13. The furniture system of claim 9, wherein said base unit includes channel means for retaining an electrical supply cable.

14. The furniture system of claim 9, further comprising an ergonomic shelf mounted between said stanchions, said shelf comprising a horizontal elongated panel having first and second parallel spaced-apart ends, a square longitudinal rear edge extending between said first and second ends, and a downwardly beveled front longitudinal edge, said front edge being laterally rearwardly curved in an arc defined by a radius extending from said seating position to a predetermined endpoint.

* * * * *